US005833509A

United States Patent [19]

Hunt

[11] Patent Number: 5,833,509

[45] Date of Patent: Nov. 10, 1998

[54] BENDABLE FIGURINE BOOK

[75] Inventor: Waldo Henley Hunt, Encino, Calif.

[73] Assignee: Intervisual Books, Inc., Santa Monica, Calif.

[21] Appl. No.: 872,815

[22] Filed: Jun. 11, 1997

[51] Int. Cl.[6] ..... A63H 3/00; A63H 33/38; A63H 3/02

[52] U.S. Cl. ..... 446/73; 446/147; 446/370; 281/15

[58] Field of Search ..... 446/71, 72, 73, 446/80, 147, 148, 151, 218, 327, 369, 370, 374, 375, 382; 434/178, 429; 281/15, 15.1, 29, 51

[56] References Cited

U.S. PATENT DOCUMENTS

| | | | |
|---|---|---|---|
| D. 143,943 | 2/1946 | Baumann . | |
| 328,221 | 10/1885 | Hood . | |
| 897,332 | 9/1908 | Wilson . | |
| 1,355,799 | 10/1920 | Bradish | 446/370 |
| 1,490,295 | 4/1924 | Stephens . | |
| 2,132,121 | 10/1938 | Nudelman . | |
| 2,486,330 | 10/1949 | Schade . | |
| 3,119,197 | 1/1964 | Adams . | |
| 3,235,988 | 2/1966 | Paige . | |
| 3,289,333 | 12/1966 | Watrous, Jr. . | |
| 3,715,816 | 2/1973 | White . | |
| 3,755,925 | 9/1973 | Court . | |
| 3,775,867 | 12/1973 | Chistenberry, Jr. . | |
| 3,793,758 | 2/1974 | Feldhusen et al. . | |
| 3,938,831 | 2/1976 | Herman . | |
| 4,011,940 | 3/1977 | Neal et al. . | |
| 4,176,473 | 12/1979 | Rae . | |
| 4,280,241 | 7/1981 | Pfaff . | |
| 4,313,270 | 2/1982 | Volkert et al. . | |
| 4,372,077 | 2/1983 | Balbuena | 434/478 X |
| 4,439,941 | 4/1984 | Halperin . | |
| 4,508,515 | 4/1985 | Skolnick | 446/148 |
| 4,597,743 | 7/1986 | Becker et al. . | |
| 4,608,024 | 8/1986 | Skolnick | 446/148 |
| 4,673,608 | 6/1987 | Cline . | |
| 4,832,648 | 5/1989 | Theobald et al. . | |
| 4,865,574 | 9/1989 | Kobayashi . | |
| 4,874,340 | 10/1989 | Smallwood . | |
| 4,909,542 | 3/1990 | Marks . | |
| 4,950,196 | 8/1990 | Fortune et al. | 446/73 |
| 4,978,141 | 12/1990 | Wu . | |
| 5,007,636 | 4/1991 | Pagani . | |

(List continued on next page.)

FOREIGN PATENT DOCUMENTS

| | | | |
|---|---|---|---|
| 382589 | 10/1923 | Germany | 446/370 |
| 2197800 | 6/1988 | United Kingdom | 446/370 |

OTHER PUBLICATIONS

Two sheets of application drawings.

Three sheets photographs of "Fruit Trooper Patience" book product.

*Primary Examiner*—Robert A. Hafer
*Assistant Examiner*—D. Neal Muir
*Attorney, Agent, or Firm*—Oppenheimer Wolff & Donnelly LLP

[57] ABSTRACT

A children's book joined with a bendable figurine to form a figurine book assembly which functions not only as a book but also as an object for play so that the child's interest is sustained in the book. The figurine is a three dimensional character or object which is joined to the book and can be shaped to appear as a character or object in the story of the book. The book can be attached to the figurine so that the figurine extends out beyond the four corners of the book and is thereby at least partially visible from a front of the book. The figurine can have an upper portion that extends over the top of the book and is made of a bendable material so that it can be bent down by the child user over the front cover of the book, thereby holding the book closed. When the child wishes to open the book, the child bends the upper portion up and out of the way of the front cover. The upper portion can be configured as an upper limb like an arm. The book is connected to the figurine with a plug connector which is secured to the back or front cover of the book and fits into a hole in the front or back of the figurine.

31 Claims, 4 Drawing Sheets

U.S. PATENT DOCUMENTS 5,020,828 6/1991 Moor .
5,021,020 6/1991 Hambly et al. ..... 446/370 X
5,049,078 9/1991 Thomsen .
5,059,149 10/1991 Stone ..... 446/71 X
5,083,961 1/1992 Ishiwa .
5,213,368 5/1993 Wyant .
5,383,684 1/1995 Smath .
5,540,462 7/1996 Lausdahl et al. .
5,601,469 2/1997 Yang ..... 446/73

FIG. 4
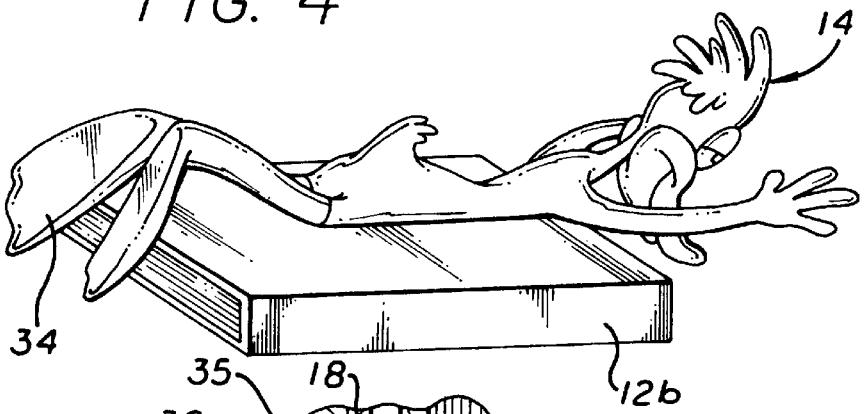
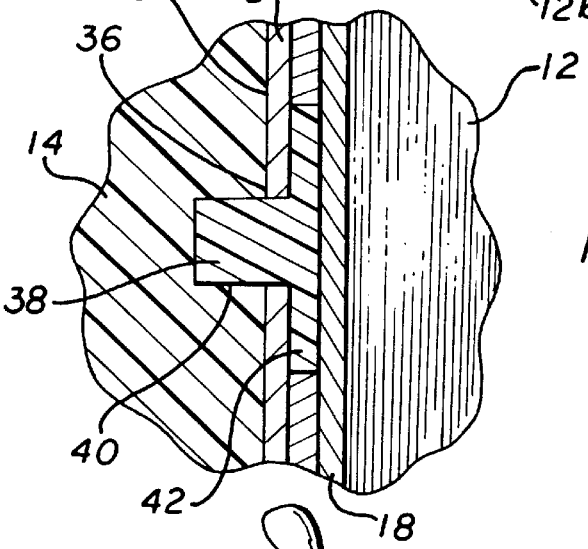
FIG. 5
FIG. 7
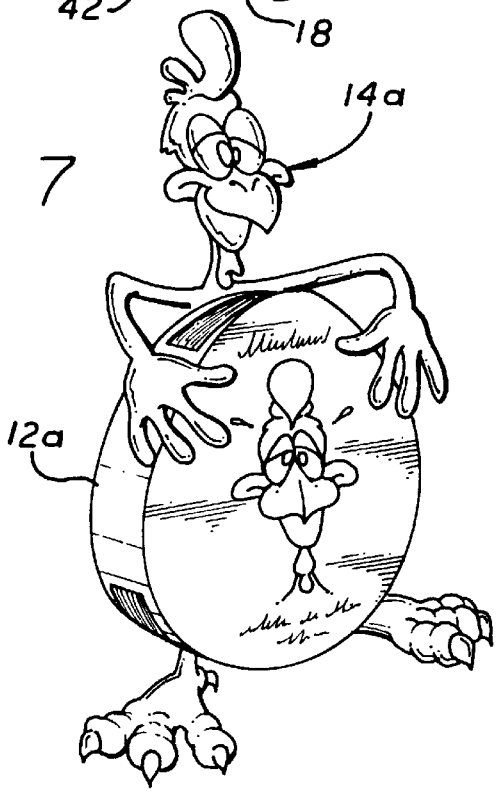

BENDABLE FIGURINE BOOK

BACKGROUND OF THE INVENTION

The present invention relates to books and, more particularly, to a children's type book joined with a bendable figurine.

In this world of movies, television and video games, children spend increasingly less time reading books. As a result, makers of books have been challenged to create books that attract children and sustain a child's interest. Particularly popular children's books are interactive books with which the child can play while reading. In pop-up books, for example, the characters illustrated within the book pop up when the page is opened or a slide out tab is pulled by the child. The pop-up characters take on a three dimensional appearance which helps to bring the story to life for the child. Such pop-up books include those produced by Intervisual Books, Inc., of Santa Monica, Calif. Still other attempts at creating interesting books for children are shown in U.S. Pat. Nos. 4,909,542 and 4,832,648, which show books formed in the shape of a character, and U.S. Pat. No. 5,059,149, which shows a book placed inside the stomach of a stuffed animal.

As children become increasingly familiar with each new type of book, their interest in them tends to fade. Accordingly, there is a continuing need to create new and unique book constructions which excite and hold a child's interest by bringing the characters and story to life for the child, and which make the reading of the books a more interactive and enjoyable experience.

SUMMARY OF THE INVENTION

One object of the present invention to provide a children's book which functions not only as a book but also as an object for play so that the child's interest is sustained in the book. Accordingly, a figurine book assembly is herein provided wherein the figurine is a three dimensional character or object which is joined to the book. To help bring the story of the book to life for the child the figurine and even the book itself can be shaped to resemble characters or objects in the story. The book can be attached to the figurine so that the figurine extends out beyond the four corners of the book and is thereby visible from a front of the book. For example, the figurine can be connected to the book through the use of a plug connector which is permanently secured to the back cover of the book and fits permanently into a hole in the front of the figurine. Alternatively, the figurine can be permanently secured to the front cover and/or the plug connector can fit in a hole in the back of the figurine. The figurine may be adjusted in position so that a portion thereof engages the book to hold it open or closed as desired by the user.

It is another object of the present invention to provide a book which sustains a child's interest therein by providing a mechanism for the child to interact with the book and its characters. Accordingly, the figurine of the present invention may have an upper portion that extends over the top of the book. The upper portion (such as the arms or hands of the figurine character) may be made of a bendable material so that it can be bent down by the child user over the front cover of the book to hold the book closed. When the child wishes to open the book, the child bends the upper portion up and out of the way of the front cover. As the child turns each page of the book, the child can bend the upper limb back down so as to hold the book open to a particular page. The upper portion can be configured to include at least one upper limb which extends over the top of the book and can be bent over the book cover and pages to hold the book open or closed. Thereby, it can also help very young children develop dexterity skills as they manipulate the hands and arms of the figurine between book held open and book held closed positions.

The figurine book assembly of the present invention can stand generally upright balanced on at least one lower limb or a portion of the figurine which extends below the book. The assembly thereby defines a decorative item for display in the child's room on the child's bureau or bookcase, for example. The figurine also helps the children, especially very young children, readily identify the book and its story line, not only in their bedrooms but also on store shelves.

BRIEF DESCRIPTION OF THE DRAWINGS

FIG. 4 is a perspective view of an alternative embodiment of a figurine book assembly of the present invention;

FIG. 5 is an enlarged cross-sectional view taken on line 5—5 of FIG. 1, particularly showing how the book is secured to the figurine through the use of a flanged plug;

FIG. 7 is a perspective view of another alternative embodiment of a figurine book assembly of the present invention, particularly showing a book having a shape corresponding to the story line.

DETAILED DESCRIPTION OF THE PREFERRED EMBODIMENTS OF THE INVENTION

Figure 1:
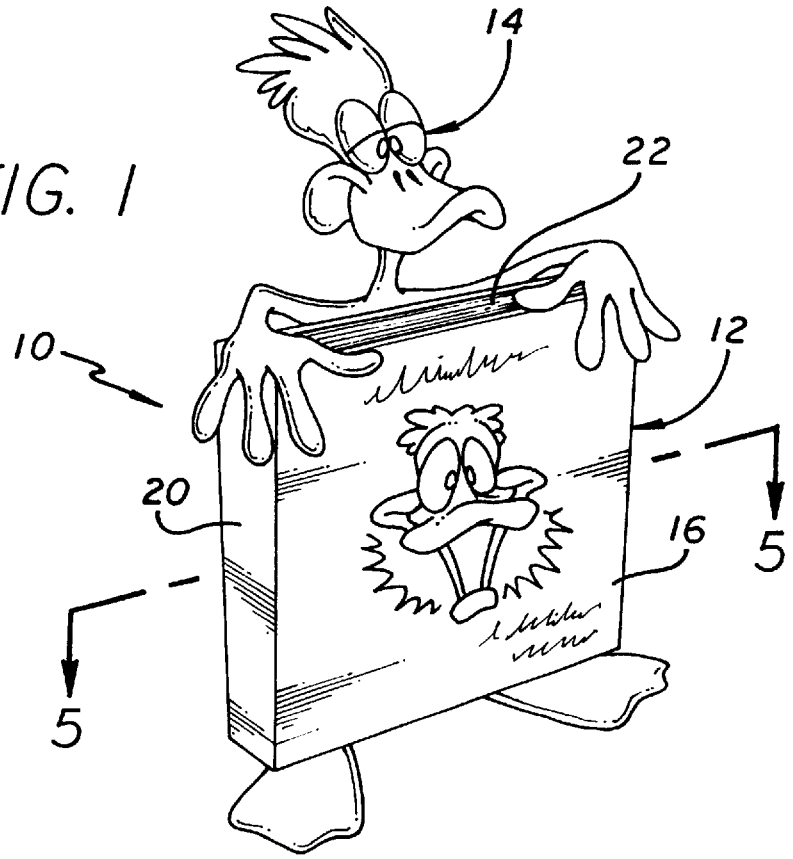
FIG. 1 is a perspective view of an exemplary embodiment of a figurine book assembly illustrating principles of the present invention, particularly showing the figurine thereof in a position with its hands bent down holding the book thereof closed.

A figurine book assembly in accordance with a preferred embodiment of the present invention is illustrated in FIG. 1 generally at 10. The figurine book assembly 10 includes a book 12 joined to a figurine 14. The book 12 has a front cover 16 and a back cover 18, wherein the two covers are bound along a spine of the book 20. The book has pages 22 which may also be bound at the spine. The covers 16, 18 are preferably sufficiently stiff so that they not only provide support for the figurine book assembly 10, but also protect the pages 22 from damage. The pages 22 consist of a number of trimmed sheets of paper which typically make up books and are preferably designed for children, both in terms of physical structure and content. Each of the pages 22 is preferably durable and able to withstand repeated, and often careless, use by a child. The pages 22 may comprise a single substantially stiff board type sheet of laminated paper board or card stock on which images and text are printed.

As shown in FIG. 7, the book 12*a* can be shaped or decorated so that it corresponds with the story line within the book, and the figurine 14*a* can be correspondingly configured. Additionally, referring to FIG. 4, with the book lying down flat, the figurine 14 looks like he is "riding" the book.

Thus, book 12*b* can be configured, shaped or decorated to resemble a surf board, a boogie board, a magic carpet or the like, particularly where such object relates to the story in the book.

Figure 2:
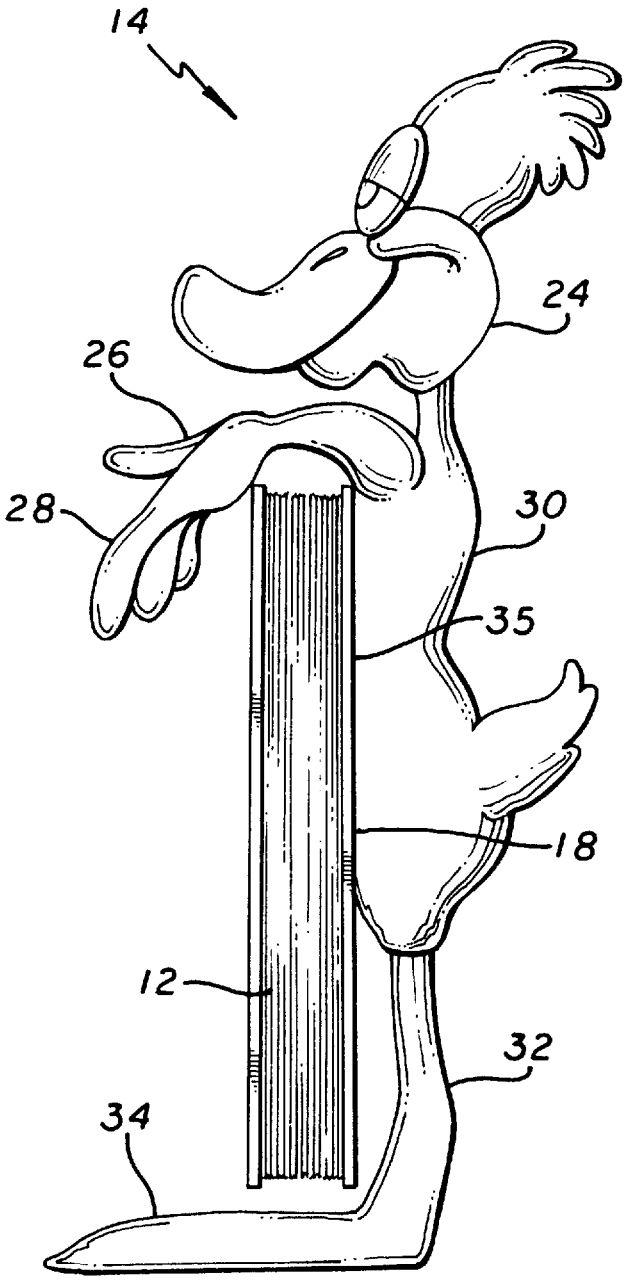
FIG. 2 is an enlarged side elevational view of the figurine book assembly of FIG. 1.

The figurine 14, as shown in FIG. 2, has a head 24 which may extend above the book, at least one upper limb 26, hands 28 at the end of the upper limbs, a body 30, at least one lower limb 32 and feet 34 at the end of the legs. The front of the body 30 is flattened on surface 35 so that it can be joined to the flat back cover 18 of the book 12. The figurine 14 can be made to appear as an animal-type character, such as an animal, a person, or as an object such as a tree or an airplane. Accordingly, the figurine 14 may have only one upper or one lower limb or multiple limbs, and the head 24 need not be that of a character but can be the top of an object such as the top of a tree or building. Preferably, the figurine's appearance matches one of the principal characters or objects featured in the story line of the book 12.

The figurine 14 can be manufactured from any suitable material including, for example, a bendable wire reinforced flexible plastic such as polyurethane. Pursuant to a preferred embodiment of the invention the figurine 14 is made by molding it over a bendable metallic wire skeleton. That is, the figurine 14 can be made of any suitable flexible plastic such as polyurethane.

Figure 3:
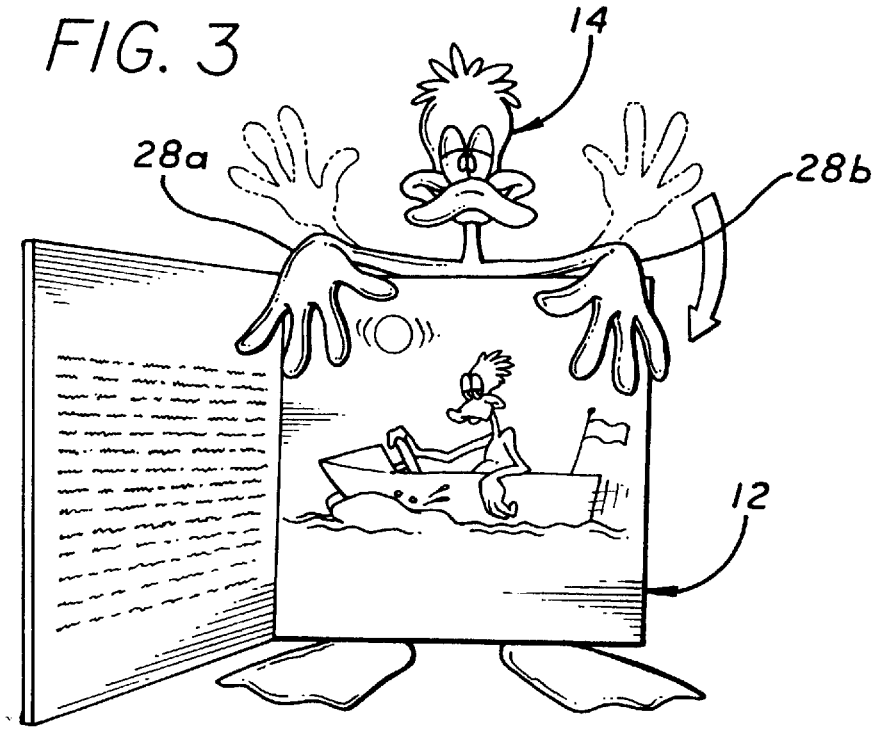
FIG. 3 is a front elevational view of the figurine book assembly of FIG. 1 illustrating principles of the present invention, particularly showing the bending up of the figurine's hands so that the book can be opened or a page turned and the bending down of the figurine's hands so that the book can be held open to a particular page or held closed.

As shown in FIG. 3, the hands 28*a*, 28*b* of the figurine 14 are bendable and are designed to be repositioned over the top of the book 12. The hands 30*a*, 30*b* can be bent down to hold the book 12 closed. When it is time to read the book 12, the hands 30*a*, 30*b* can be bent by the child user, for example, upward to allow the cover 16 of the book to be opened, as depicted by the dotted line representation in FIG. 3. Once the cover 16 is opened, the hands 30*a*, 30*b* can be bent back down to hold the book 12 open to a specific page. This same process can be repeated to change the pages 22 time and again as the book 12 is being read. As the adult reads the book, the child listener can turn the pages and bend the hands 30*a*, 30*b* back and forth, further involving and interesting the child in the reading activity. Additionally, the hands 30*a*, 30*b* not only hold the book 12 open to a specific page 22, but also can act as a page marker by leaving one hand within a given page, while the other hand holds the book closed.

Figure 6:
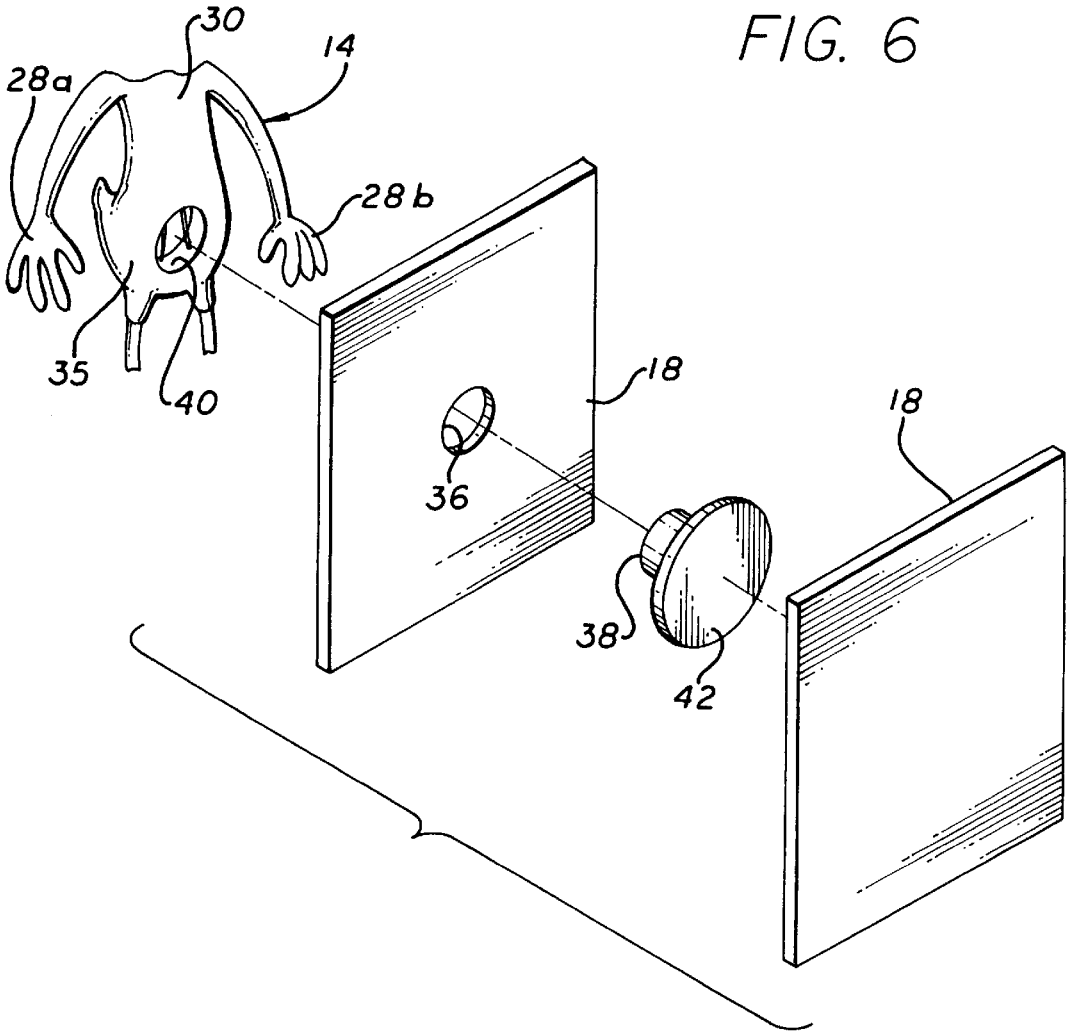
FIG. 6 is an exploded perspective view showing the plug connection of FIG. 5.

As shown in FIG. 2, the book 12 is joined to and flat against the body of the figurine 14; the front figurine's body 35 is sufficiently flat so that the back cover 18 of the book 12 can be joined flat against it. The back cover 18 of the book is attached to the flattened front surface 35 of the body 30 of the figurine 14. The book 12 is joined permanently to the figurine 14 by special plastic cement adhesive. In a preferred embodiment, shown in FIGS. 5 and 6, the back cover 18 of the book 12 contains a hole 36 through which a plug 38 is inserted. The figurine 14 has a corresponding hole 40 in the flattened portion 35 of the front of its body 30. The plug 38 is inserted through the hole 36 of the back cover 18 of the book 12 and into the hole 40 within the figurine 14, and secured therein with the adhesive. A flange 42 on the plug 38 provides further support for securing the back cover 18 of the book 12 to the figurine 14. Preferably, the figurine book assembly 10 is balanced so that it can stand upright on the figurine's feet 34, as shown in FIGS. 1, 2, 3 and 7.

What is claimed is:

1. A book assembly, comprising:

a book having a back cover and at least one page or front cover, said back cover having a top edge;

a head of a figure, said head being supported by said back cover and extending up from and above said top edge;

an arm of the figure, said arm being supported by said back cover; and a hand at an end of said arm and having at least one digit;

wherein the figure has an internal metallic armature, at least one of said hand and said arm being bendable by a user between (a) an engagement position in which said hand engages one of said at least one page or front cover to self-hold same, in an at least partially open position or closed position relative to said back cover and (b) a retracted position in which said hand is out of engagement with said at least one page or front cover.

2. The book assembly of claim 1 wherein said arm extends up from and above said top edge.

3. The book assembly of claim 1 further comprising at least one leg of the figure, said at least one leg extending down from and below a bottom edge.

4. The book assembly of claim 1 further comprising a body of the figure to which said head and said arm are attached.

5. The book assembly of claim 4 wherein said body is directly attached to said back cover.

6. The book assembly of claim 4 further comprising a leg of the figure, said leg being attached to said body and extending down below a bottom edge of said back cover.

7. The book assembly of claim 4 wherein said body is configured such that no portion thereof extends out beyond side edges of said book.

8. The book assembly of claim 1 wherein said arm, when said hand is in the engagement position, extends over said top edge.

9. The book assembly of claim 1 wherein said arm is bendable relative to said book and said hand is bendable relative to said arm.

10. The book assembly of claim 1 wherein said hand is bent down relative to an adjacent portion of said arm when said hand is in the engagement position.

11. The book assembly of claim 1 wherein said hand is bendable up by a user relative to the engagement position thereof to reposition said hand to the retracted position.

12. The book assembly of claim 1 wherein said digit includes a finger of said hand.

13. The book assembly of claim 1 wherein said digit includes a thumb of said hand.

14. The book assembly of claim 1 wherein said at least one page or front cover includes a front cover and a plurality of pages.

15. The book assembly of claim 14 wherein said hand engages at least one of said pages when said in the engagement position.

16. The book assembly of claim 14 wherein said hand engages said front cover when in the engagement position.

17. The book assembly of claim 1 wherein said arm defines a first arm, said hand defines a first hand, and further comprising a second arm of the figure supported by said back cover, and a second hand on said second arm and also positionable in engagement and retracted positions relative to said book.

18. The book assembly of claim 17 wherein both of said first and second hands have fingers.

19. The book assembly of claim 17 further comprising a neck of the figure, said head and said arms being attached to and extending out from said neck.

20. The book assembly of claim 1 wherein the appearance of the figure conforms with that of a character in a story of said book.

21. The book assembly of claim 1 further comprising a body portion of the figure directly connecting said head with said arm.

22. The book assembly of claim 14 wherein said hand when in the engagement position self-holds said front cover in the closed position.

23. The book assembly of claim 1 wherein said hand when in the engagement position self-holds one of said at least one page or front cover in the at least partially open position.

24. The book assembly of claim 1 wherein said book has a rectangular front shape.

25. A book assembly, comprising:

a book having a back cover and at least one page or front cover, said back cover having a top edge and a bottom edge;

a head of a figure, said head being supported by said book and extending up from and above said top edge;

at least one arm of the figure, said at least one arm being supported by said book;

at least one leg of the figure, said at least one leg extending down from and below said bottom edge;

at least one foot of the figure at an end of at least one of said legs;

a body of the figure, said body having a flat stomach; and a plug connecting said flat stomach to said back cover;

wherein the figure has an internal metallic armature supporting said at least one leg, said at least one leg, with said at least one foot engaging a support surface, forming a self-standing support for said book on the support surface.

26. The book assembly of claim 25 wherein said at least one leg comprises first and second legs.

27. The book assembly of claim 26 wherein said at least one foot defines a first foot attached to said first leg and a second foot attached to said second leg.

28. The book assembly of claim 25 wherein said body is configured such that no portion thereof extends out beyond sides of said book.

29. The book assembly of claim 25 wherein said at least one arm extends up above said top edge.

30. The book assembly of claim 25 wherein said at least one page or front cover comprises a plurality of pages and a front cover.

31. The book assembly of claim 25 wherein the appearance of the figure conforms with that of a character in a story of said book.

* * * * *